United States Patent [19]

Rodgers

[11] Patent Number: 4,848,009

[45] Date of Patent: Jul. 18, 1989

[54] FLASHING FOOTWEAR

[76] Inventor: Nicholas A. Rodgers, 15 Blair Lane, R.R. #1, Perkinsfield, Ontario, Canada, L0L 2J0

[21] Appl. No.: 165,930

[22] Filed: Mar. 9, 1988

[51] Int. Cl.[4] ..... A43B 3/00; A43B 7/04; F21V 33/00

[52] U.S. Cl. ..... 36/137; 362/103

[58] Field of Search ..... 36/107, 1; 362/103

[56] References Cited

U.S. PATENT DOCUMENTS 3,893,247 7/1975 Dana III ..... 36/137

4,158,922 6/1979 Dana III ..... 36/137

FOREIGN PATENT DOCUMENTS 121026 10/1984 European Pat. Off. ..... 36/137

2608485 9/1977 Fed. Rep. of Germany ..... 36/137

*Primary Examiner*—James Kee Chi

[57] ABSTRACT

Articles of footwear are provided with a battery and a light source and a motion responsive switch to intermittently connect said battery to said light source. The light source is preferably an LED and there is preferably a circuit to extinguish the light after a predetermined interval.

5 Claims, 3 Drawing Sheets

FLASHING FOOTWEAR

Figure 1:
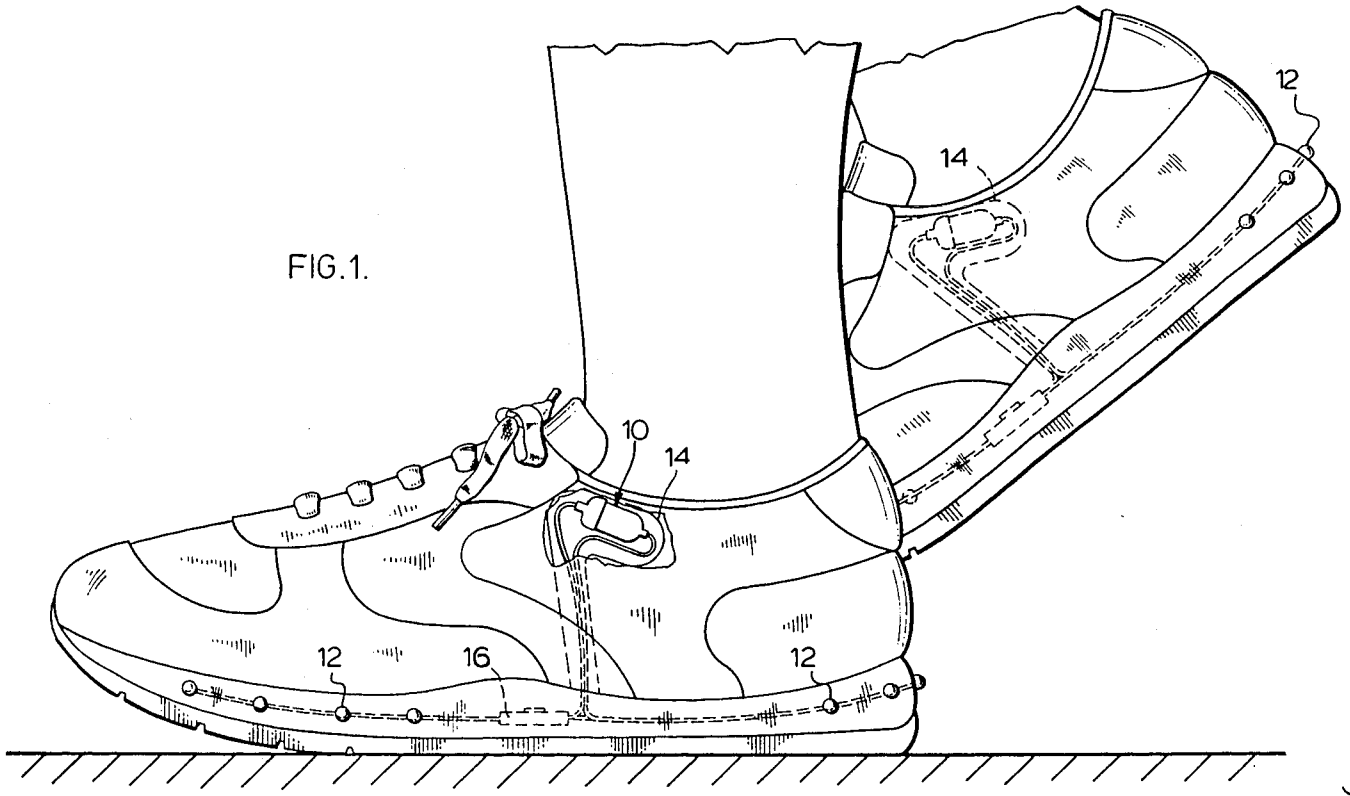

This invention relates to illuminated footwear.

It has been previously known to provide footwear with constant illumination, or with intermittently flashing illumination. See for example U.S. Pat. No. 4,158,922 issued June 26, 1979 to Disco Enterprises Inc. Such device does not provide means for extinguishing the illumination if constantly on or stopping the intermittent flashing. Where the patented device uses a mercury switch the illumination will stay on or stay flashing if the attitude of the mercury switch leaves it in "on" position.

In one aspect of the invention there is provided footwear with at least one light source located thereon to be visible exteriorly of said footwear; a power source for energizing said light source; a circuit for selectively energizing said power source with said at least one light source, means responsive to motion of said footwear to connect said power source to said light source to illuminate said source; including a switch designed to alternate between "off" and "on" states responsive to motion of said footwear and a timing circuit responsive to the transition of the switch from "off" to "on" state to turn off said light source after a predetermined illumination duration and to prevent re-illumination of said light source until a further "off" to "on" transition of said switch.

Thus with this aspect of the invention, the light cannot be on continuously but only for a predetermined interval after the switch goes to 'on' state. The battery life is thus prolonged and an exciting flashing effect is produced.

In previous examples of illuminated footwear, so far as is known an incandescent light source is used. Such light source tends to require high electrical energy tending to shorten battery life and to increase the size of circuit components.

In another aspect of the invention there is provided footwear having at least one light emitting diode ('LED' hereafter) located on said footwear to be visible exteriorly thereof; a power source for energizing said at least one LED; a circuit for selectively electrically connecting said power source with said at least one LED; and means responsive to the motion of said footwear for causing said circuit to connect said power source to said at least one LED to illuminate the latter.

The use of LED's produces a bright display in selected colors which requires much less energy than would the use of incandescent illumination, thus giving longer battery life. Since LEDs require less power than other sources battery and other components may be of smaller size and cost. Such smaller size is of considerable importance in footwear. LEDs also provide a relatively high intensity relative to their power requirements.

With regard to both aspects of the invention, it is noted that glass fibre may be used, if desired to conduct light from the light source to the exterior of the shoes. In some cases glass fibres may be undesirable because they have a relatively narrow beam.

There are many alternatives available for the motion responsive means used in the other aspect of the invention to switch the ligtht source on and off, it has been found that for ruggedness, operation and compactness that a mercury switch is preferred. In one aspect of the invention the circuitry only allows the light source to be illuminated on change of the switch to 'on' state and terminates the illumination after a predetermined period after the switch changes state from "off" to "on".

It is noted that within the scope of the invention, a timing circuit, (preferably an integrated circuit) may be used to control illumination duration start or stop times when illumination is called for by the motion responsive means. In a preferred embodiment a timing circuit (whether integrated or otherwise) is provided designed to limit the illumination to a set period after the switch has closed. This feature is of particular advantage where the switch is turned on by the attitude of the shoe (as, for example by a mercury switch). The timing circuit designed to limit illumination duration will thus prevent loss of battery power if the shoes are stored in an attitude which would maintain switch closure for an extended period.

Figure 4:
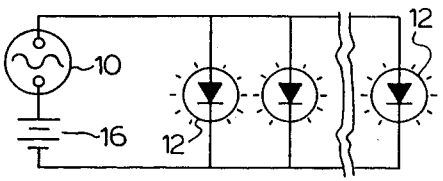
Figure 2:
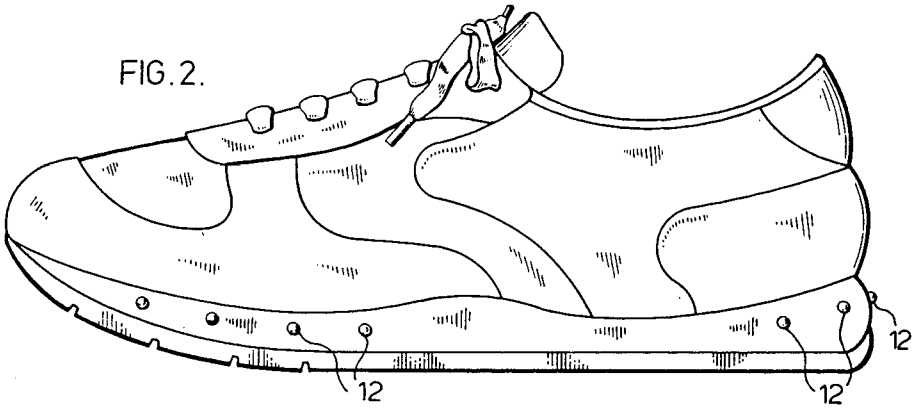
Figure 3:
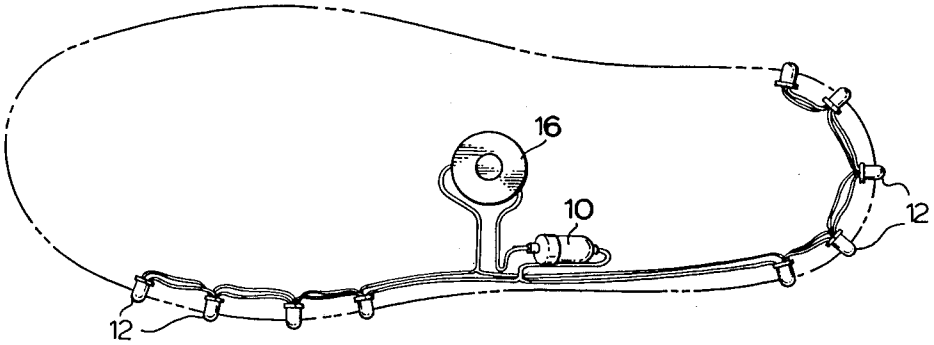

In drawings which illustrate a preferred embodiment of the invention:

In the drawings:

FIG. 1 shows a pair of running shoes in accord with the invention showing some circuit components in dotted form, FIG. 2 shows the exterior of a running shoe of FIG. 1, FIG. 3 shows the physical circuitry of the shoe of FIG. 2 with the shoe outlined in chain dots, FIG. 4 shows the wiring diagram for the circuit of FIG. 1–3, FIG. 5 shows an alternative circuit containing a timing circuit.

In FIGS. 1–4 a mercury switch 10 and nine LEDs 12 are preferably encapsulated in the running shoe during manufacture. A battery 16 is located in a pouch 14 or under a flap attachable by hook and loop fastener means after identified by the trademark Velcro or by other conventional means inside this shoe. The battery may be connected to be easily disconnected, replaced and connected, again by conventional means. Although it is preferred to encapsulate the LEDs 12 and the mercury switch 14 in the shoe, these might be attached to the exterior of the shoe if desired, and the switch 14 might also be attached to the exterior. The switch whether mercury or other conventional type will be designed when using the circuitry of FIG. 4 to be "off" when the shoe is horizontal and stationary. The battery 16 which may be of any conventional type, preferably is of the lithium chloride type.

FIG. 4 shows the circuit connections. As shown in FIG. 4 the battery 16 is connected through mercury switch 10 to LEDs 12 connected in parallel. The mercury switch may be on or off depending on the positioning of the mercury therein and is arranged to be off when the shoe is horizontal and stationary. It should be noted that using this circuit may lead to premature depletion of battery power where the shoe is held or left in such a position that the mercury switch 10 remains closed.

Figure 5:
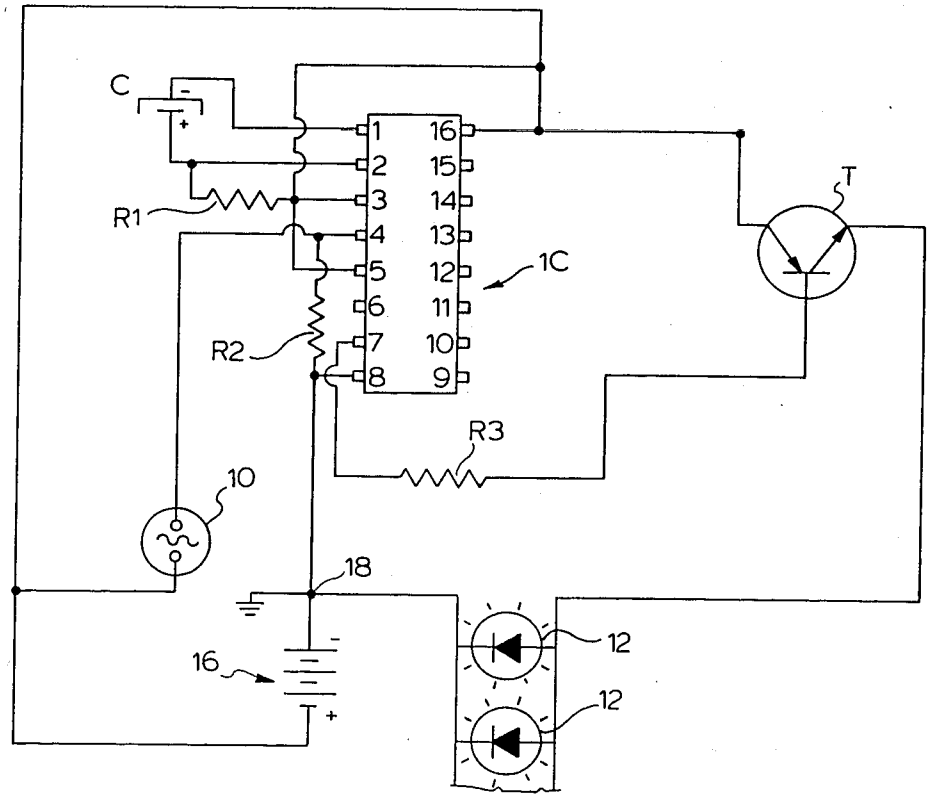

FIG. 5 shows circuitry including an integrated circuit used to time illumination of LEDs 12. It will be understood that switch 10, battery 16, LEDs 12 may be located as indicated in FIGS. 1–3. The integrated circuit IC, transistor T and the remainder of the elements shown in FIG. 4 are encapsulated in the material of the shoe, preferably adjacent mercury switch 10.

Preferred values for the circuit elements are as follows:

IC - INTEGRATED CIRCUIT #RR8503 MC14528

T - TRANSISTOR #2N3906
C - CAPACITOR 0.47 μF at 30 V
10 - BATTERY 3 V
12 - LIGHT SOURCE (LED)
16 - ACTIVATION SWITCH (MERCURY) MECHANICAL OR PIEZOTRONIC
R1 - RESISTOR 1 MEGOHM $\frac{1}{8}$ w
R2 - RESISTOR 1 MEGOHM $\frac{1}{8}$ w
R3 - RESISTOR 1 MEGOHM $\frac{1}{8}$ w (A mechanical or a piezotronic switch may be used as an alternative to mercury switch 10).

(The integrated circuit and transistor referred to above are both available from Motorola Canada Limited, 3125 Steeles Avenue East, North York, Ontario, Canada).

In operation, with the shoe stationary and horizontal, the switch 10 will be open and the circuit quiescent but capacity C will be charged to the value of battery 16 (here 3 V). Pin 4 of the integrated circuit will be held at 0 volts which is the voltage arbitrarily designated at node 18. The integrated circuit IC will be in reset condition having the effect that there will be a positive voltage at pin 7, rendering the transistor T non-conducting and maintaining the LEDs 12 off.

When motion of the shoe causs switch 10 to complete this circuit battery 16 and pin 4, (that is the switch is changing state from "off" to "on"); the (0–1) or 0 V to 3V transition at pin 4 causes the integrated circuit to go to "set" condition causing pin 7 of IC to go to 0 volts. This causes transistor T to conduct lighting LEDs 12. The set condition of IC connects pin 3 with node 18 and in a time determined by C and R1 the circuit is returned to reset condition, extinguishing LEDs 12 and allowing C to recharge. The circuitry is further designed so that switch 10 must be turned off and on again before the integrated circuit can again be activated to set state.

It will be appreciated that the 'ground' shown at node 18 is instrument ground only and is unconnected to anything outside the shoe. The choice of node 18 as 'ground' is somewhat arbitrary but assists on the description of the circuit.

The use of the circuitry shown in FIG. 5 transcends the need for an off attitude of the footwear to conserve battery power as it ensures only one momentary illumination of the LEDs per switch 10 closure. This allows the shoe to be held or left where, due to the attitude of the shoe, switch 10 is closed without continuing illumination of the LEDs and consequent battery 16 power depletion.

Instead of being mounted in a pouch such as 14, the battery may also be encapsulated in the shoe material when using this circuitry. Although this prevents battery replacement it should be noted that, in many cases, it is thought that the battery life will exceed that of the shoe.

Obviously it is within the scope of the invention to use any other circuit, integrated or otherwise, designed to be motion activated and to time the cessation of duration of the illumination of LEDs 12. Circuits to control the duration are of particular importance for the reasons previously explained.

Obviously there is no limitation as to the types of footwear with which the invention may be used. Thus the footwear would include shoes, boots, overshoes, overboots, slippers, rubbers, etc. and whether designed for sports, fashion or utilitarian use.

I claim:

1. Footwear comprising:

at least one light source, located on said footwear to be visible exteriorly thereof, a power source for energizing said light source, a circuit for selectively electrically connecting said power source with said at least one light source to illuminate said source, a switch, which alternates between "off" and "on" states responsive to motion of said footwear, said circuit being adapted to so connect said power source to said light source responsive to the transition of said switch to "off" to "on" state, and a timing circuit being adapted to disconnect said power source from said light source a predetermined time after said transition.

2. Footwear as claimed in claim 1 wherein said light source is an LED.

3. Footwear as claimed in claim 1 wherein said motion responsive means is a mercury switch.

4. Footwear as claimed in claim 2 wherein said motion responsive means is a mercury switch.

5. Footwear comprising:

at least one light source located on said footwear to be visible exteriorly thereof, a power source for energizing said light source, means responsive to motion of said footwear to cause illumination of said light source by said power source, including a switch which alternates between "off" and "on" states responsive to motion of said footwear, and circuit means adapted to cause illumination of said light source by said power source responsive to the transition of said switch from "off" to "on" state and a timing circuit adapted to terminate said illumination a predetermined period after said transition.

* * * * *